US010819021B2

(12) United States Patent
Shen

(10) Patent No.: US 10,819,021 B2
(45) Date of Patent: Oct. 27, 2020

(54) ANTENNA MODULE AND MOBILE TERMINAL

(71) Applicant: AAC Technologies Pte. Ltd., Singapore (SG)

(72) Inventor: Yachuan Shen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,080

(22) Filed: Jul. 28, 2019

(65) Prior Publication Data

US 2020/0044319 A1 Feb. 6, 2020

(30) Foreign Application Priority Data

Aug. 3, 2018 (CN) ..... 2018 2 1267573 U

(51) Int. Cl.
*H01Q 1/24* (2006.01)
*H01Q 5/50* (2015.01)
*H01Q 5/328* (2015.01)

(52) U.S. Cl.
CPC ..... *H01Q 1/245* (2013.01); *H01Q 1/243* (2013.01); *H01Q 5/328* (2015.01); *H01Q 5/50* (2015.01)

(58) Field of Classification Search
CPC ..... H01Q 1/245; H01Q 5/50; H01Q 5/328; H01Q 1/243; H01Q 9/42; H01Q 5/335
See application file for complete search history.

(56) References Cited

U.S. PATENT DOCUMENTS

2015/0155614 A1* 6/2015 Youn ..... H01Q 1/243 343/702
2019/0386377 A1* 12/2019 Dong ..... H04M 1/0266
2019/0387649 A1* 12/2019 Hong ..... H05K 1/144
2020/0212540 A1* 7/2020 Shen ..... H01Q 5/335

* cited by examiner

*Primary Examiner* — Daniel D Chang
(74) *Attorney, Agent, or Firm* — W&G Law Group LLP

(57) ABSTRACT

An antenna module and a mobile device are provided. The antenna module includes a radiator formed on a surface of the plastic rear housing facing the back cover, and a feed point, a first ground point, and a second ground point that are disposed on the motherboard. The antenna module further includes a matching network, a first tuning switch, and a second tuning switch. The feed point is connected to the radiator through the matching network. The first ground point is connected to the radiator through the first tuning switch. The second ground point is connected to the radiator through the second tuning switch. The surface of the plastic rear housing facing the back cover includes a first shaping zone for shaping the radiator and a second zone other than the first shaping zone, and the radiator completely covers the first shaping zone.

6 Claims, 6 Drawing Sheets

ANTENNA MODULE AND MOBILE TERMINAL

TECHNICAL FIELD

The present disclosure relates to field of communications technologies, and in particular, to an antenna module and a mobile terminal.

BACKGROUND

With the development of mobile communication technologies, mobile phones, PADs, notebook computers, and the like have gradually become indispensable electronic products in life. Such electronic products are all equipped with an antenna module and therefore become electronic communication products having a communication function.

A laser direct structuring (LDS) technology refers to projecting a laser onto a molded three-dimensional plastic device by using a computer to control movement of the laser based on a trajectory of a conductive pattern, to form a circuit pattern within a few seconds. For design and production of mobile phone antennas, a metal antenna pattern is directly formed on a molded plastic holder by electroless plating using a laser technology. The antenna pattern formed by the LDS process in the related art has a slit, and is easy to break when falling, and radium plating and electroless plating of the antenna pattern are difficult and time-consuming.

Therefore, it is necessary to provide an improved antenna module to resolve the above problems.

BRIEF DESCRIPTION OF THE DRAWINGS

To describe the technical solutions in the embodiments of the present disclosure more clearly, the following briefly describes the accompanying drawings required for describing the embodiments. Apparently, the accompanying drawings in the following description are merely some embodiments of the present disclosure, and those of ordinary skill in the art can derive other accompanying drawings from these accompanying drawings without creative efforts.

DETAILED DESCRIPTION

Figure 1:
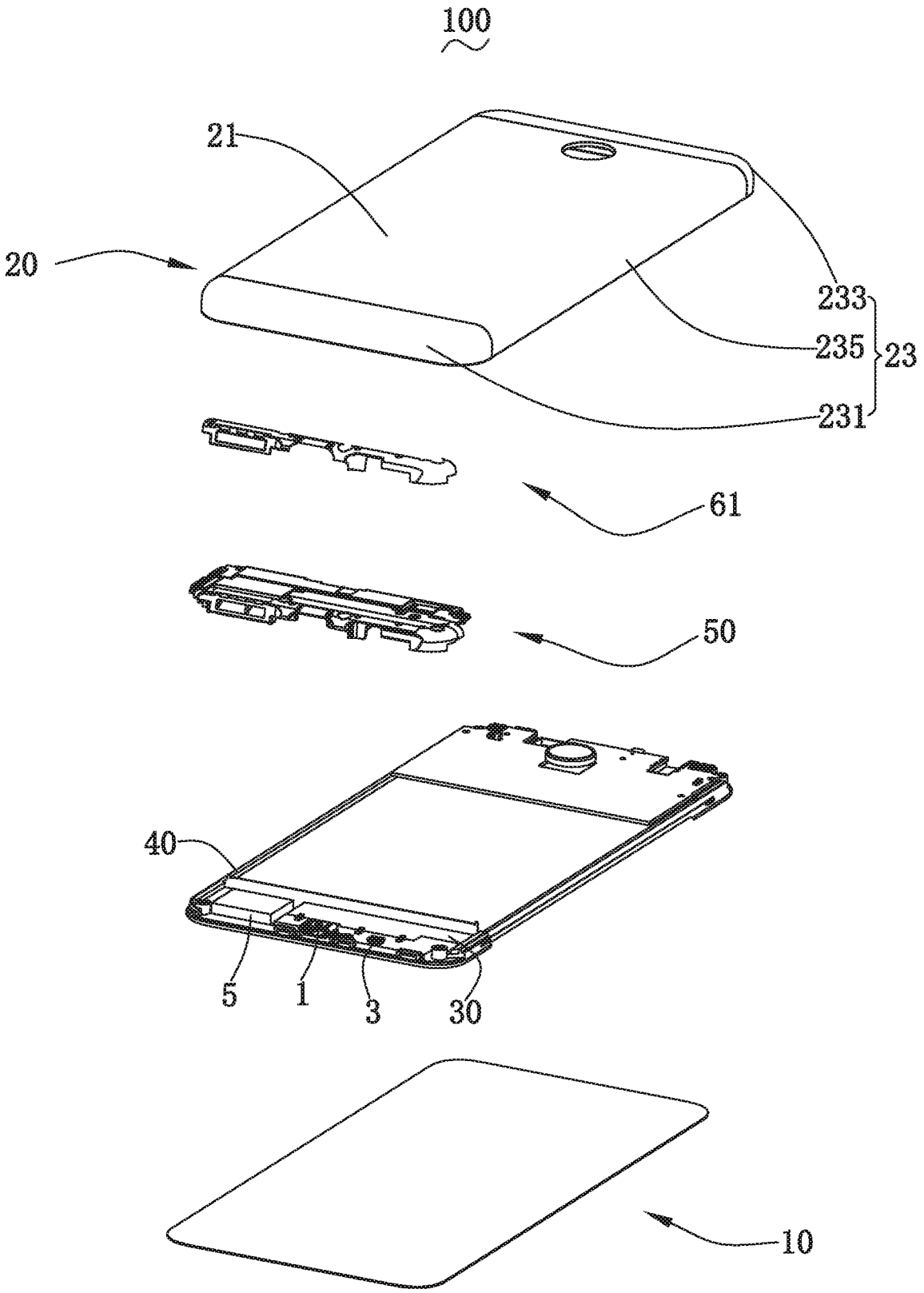
FIG. 1 is a three-dimensional schematic structural exploded view of a mobile terminal according to a preferred embodiment of the present disclosure.
Figure 2:
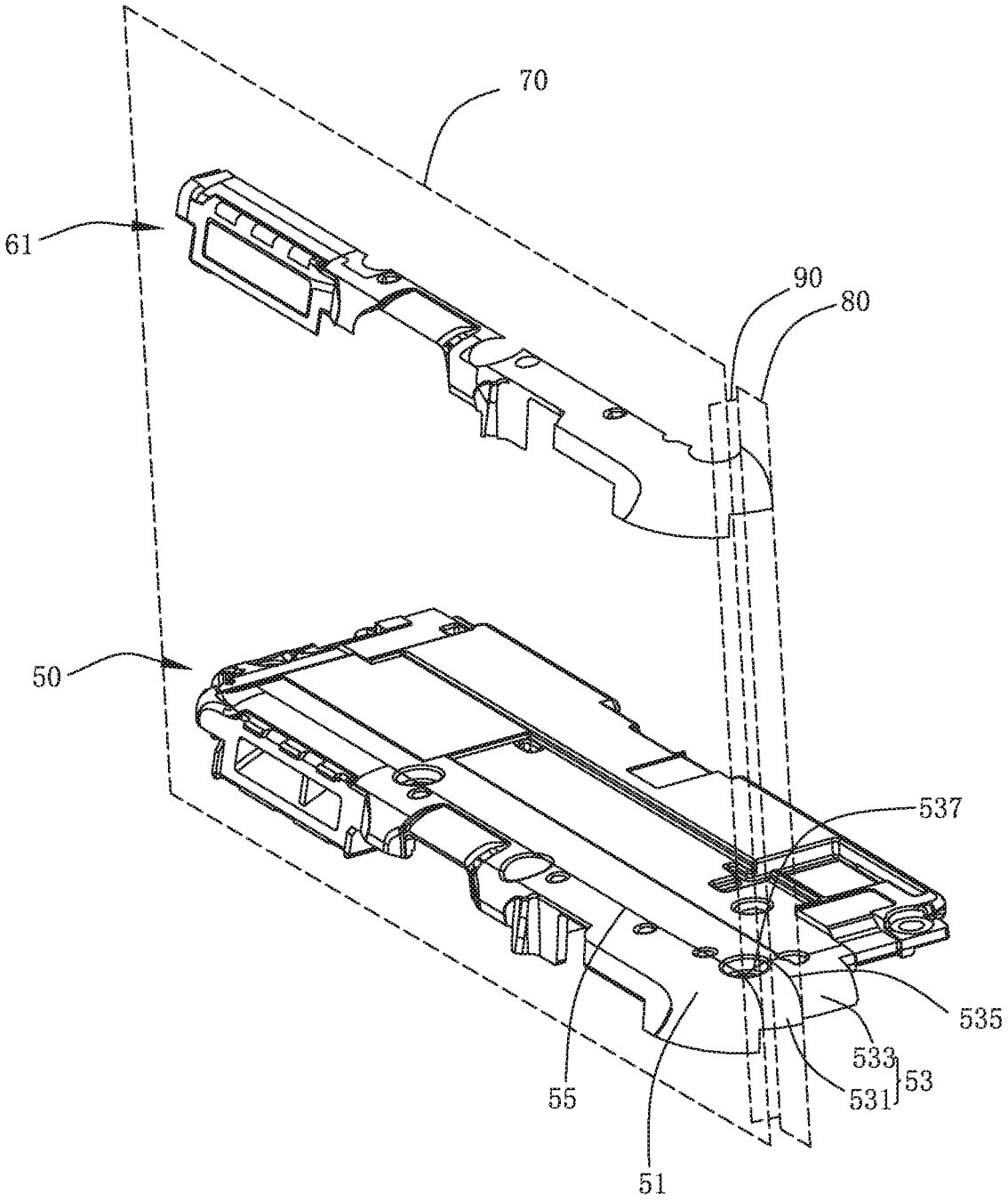
FIG. 2 is a three-dimensional schematic structural exploded view of a plastic rear housing and a radiator of the mobile terminal shown in FIG. 1.
Figure 3:
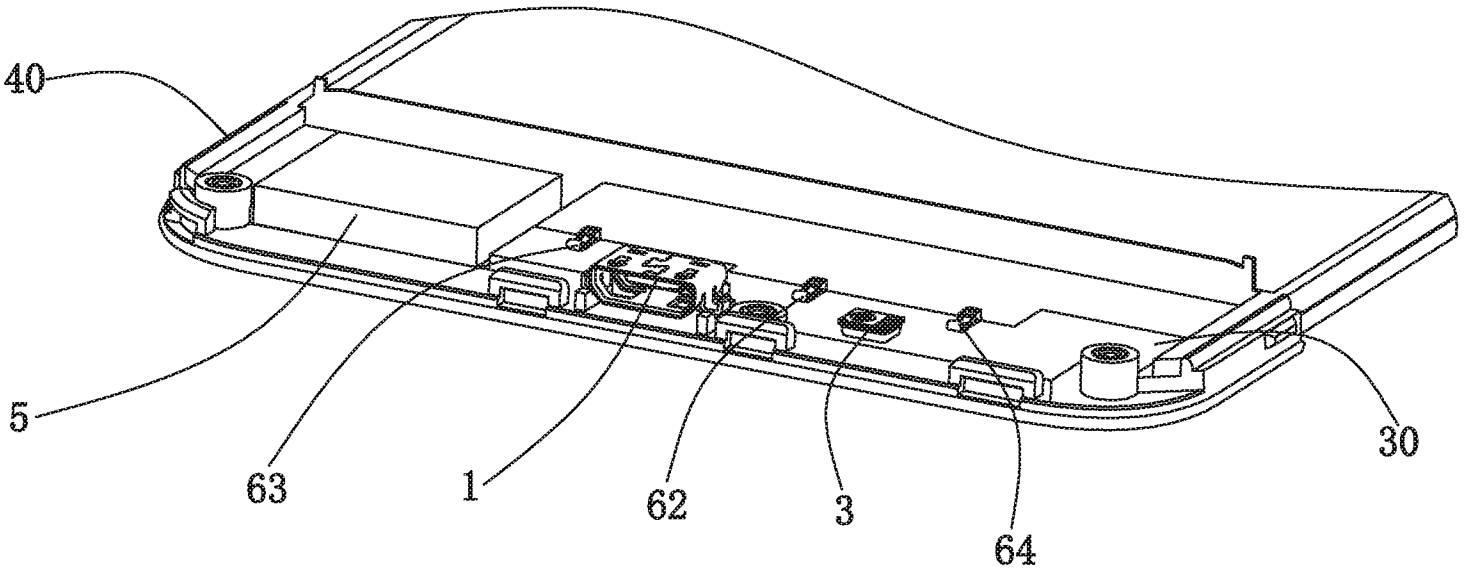
FIG. 3 is a partial three-dimensional schematic structural diagram of the mobile terminal shown in FIG. 1.

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those skilled in the art based on the embodiments of the present disclosure without creative efforts shall fall within the protection scope of the present disclosure.

As shown in FIG. 1 to FIG. 4, an embodiment of the present disclosure provides a mobile terminal 100. The mobile terminal 100 may be a mobile phone, a tablet computer, a multimedia player, or the like. For ease of understanding, a smart phone is used as an example for description in the following embodiments.

The mobile terminal 100 includes a screen 10, a back cover 20 supporting the screen 10 and defining an accommodation space together with the screen 10, a motherboard 30 received in the back cover 20, a middle frame 40 surrounding the motherboard 30 and fixedly connected to the motherboard 30, a plastic rear housing 50 located between the back cover 20 and the motherboard 30 and covering the motherboard 30, and an antenna module received in the accommodation space. The plastic rear housing 50 is disposed adjacent to a bottom of the mobile terminal 100.

The back cover 20 includes a bottom plate 21 disposed opposite to the screen 10 and a side frame 23 extending from a peripheral edge of the bottom plate 21 toward the screen 10, and the side frame 23 is connected to the screen 10. The side frame 23 includes a bottom frame 231, a top frame 233 parallel to and spaced apart from the bottom frame 231, and a mid frame 235 having two ends respectively connected to the bottom frame 231 and the top frame 233.

A radiator 61 of the antenna module is formed on a surface of the plastic rear housing 50 facing the back cover 20.

The surface of the plastic rear housing 50 facing the back cover 20 includes a first shaping zone 51 for forming the radiator 61 of the antenna module and a second zone 53 other than the first shaping zone 51. A boundary line 55 between the first shaping zone 51 and the second zone 53 lies in a first plane 70 perpendicular to the motherboard 30 and parallel to a minor axis of the mobile terminal 100. The first shaping zone 51 is located at a side of the first plane 70 close to the bottom frame 231, that is, a side of the first plane 70 close to the bottom of the mobile terminal 100.

For ease of understanding, the configuration of the first shaping zone 51 and the second zone 53 means that the surface of the plastic rear housing 50 facing the back cover 20 is divided by the first plane 70 into two parts.

The second zone 53 comprises a second shaping zone 531 for forming the radiator of the antenna module and a blank zone 532. The second shaping zone 531 is connected to the first shaping zone 51.

Only two boundary lines exist between the second shaping zone 531 and the blank zone 533. a boundary line 535 is lying in a second plane 80 parallel to the first plane 70, and a boundary line 537 is lying in a third plane 90 perpendicular to the first plane 70 and perpendicular to the motherboard 30. It should be noted that the first plane 70, the second plane 80, and the third plane 90 are all imaginary planes defined for ease of describing the shape of the radiator of the antenna module.

The radiator 61 is formed on the surface of the plastic rear housing 50 facing the back cover 20 and completely covers the first shaping zone 51 and the second shaping zone 531. Specifically, the radiator 61 completely covers the first shaping zone 51 and the second shaping zone 531 means that the radiator 61 is formed according to each feature on the first shaping zone 51 and the second shaping zone 531, and has exactly the same contour as that of the first shaping zone 51 and the second shaping zone 531. Specifically, the radiator 61 is formed on the first shaping zone 51 and the second shaping zone 531 of the surface of the plastic rear housing 50 through an LDS laser engraving process. Since the radiator 61 completely covers the first shaping zone 51 and the second shaping zone 531 and has a simple outer contour, it is unnecessary to design a complicated laser engraving path during LDS laser engraving, thereby simplifying the laser engraving process and reducing the requirements on the precision of laser engraving.

The antenna module includes the radiator 61, and a feed point 62, a first ground point 63, a second ground point 64, a matching network 65, a first tuning switch 66, and a second tuning switch 67 that are disposed on the motherboard 30. The feed point 62 is connected to the radiator 61 through the matching network 65, the first ground point 63 is connected to the radiator 61 through the first tuning switch 66, and the second ground point 64 is connected to the radiator 61 through the second tuning switch 67.

In this embodiment, the feed point 62 is located between a USB module 1 and a microphone 3, and the first ground point 63 is located on a side of the USB module 1 away from the microphone 3, that is, between a speaker module 5 and the USB module 1. The second ground point 64 is located on a side of the microphone 3 away from the USB module 1.

Figure 4:
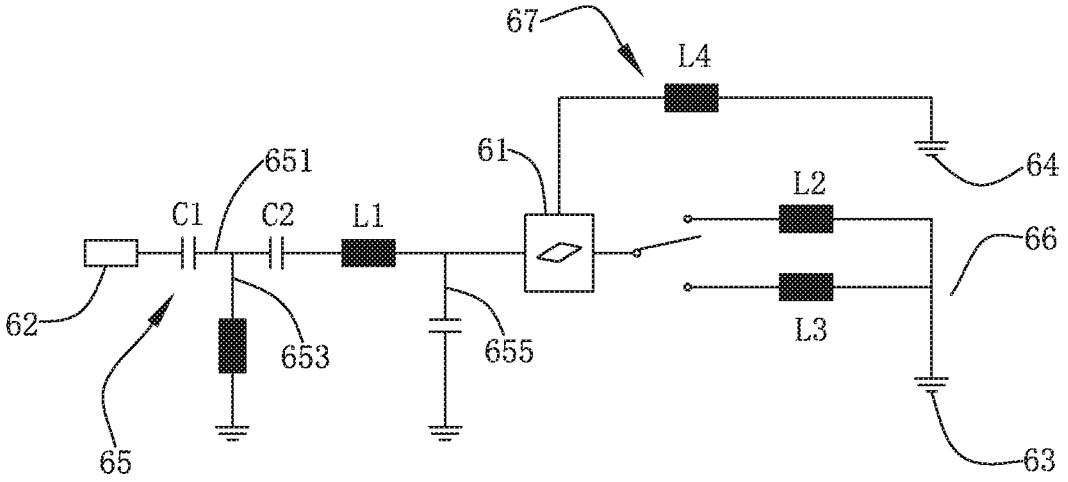
FIG. 4 is a schematic structural diagram showing circuit connections of a specific embodiment of an antenna module of the mobile terminal shown in FIG. 1.

Referring to FIG. 4, the matching network 65 includes a first branch 651, a second branch 653, and a third branch 655. Two ends of the first branch 651 are respectively connected to the feed point 62 and the radiator 61. One end of the second branch 653 is connected to the first branch 651, and the other end of the second branch 653 is grounded through an inductor of 6 nH. One end of the third branch 655 is connected to the first branch 651, and the other end of the third branch 655 is grounded through a capacitor of 1.2 pF. The first branch 651 includes a first capacitor C1, a second capacitor C2, and a first inductor L1 in sequence. A first end of the first capacitor C1 is connected to the feed point 62, a second end of the first capacitor C1 is connected to the second branch 653 and a first end of the second capacitor C2 respectively, a first end of the first inductor L1 is connected to a second end of the second capacitor C2, and a second end of the first inductor L1 is connected to the third branch 655 and the radiator 61. A value of the first capacitor C1 is 4.5 pF, a value of the second capacitor C2 is 9 pF, and a value of the first inductor L1 is 3 nH.

The first tuning switch 66 and the second tuning switch 67 both have a first operation state. The first tuning switch 66 further has a second operation state. When the first tuning switch 66 is in the first operation state, the radiator 61 is grounded through a second inductor L2. When the first tuning switch 66 is in the second operation state, the radiator 61 is grounded through a third inductor L3. When the second tuning switch 67 is in the first operation state, the radiator 61 is grounded through a fourth inductor L4. In this embodiment, an inductance value of the second inductor L2 is 60 nH, an inductance value of the third inductor L3 is 80 nH, and an inductance value of the fourth inductor L4 is 1.8 nh.

When the first tuning switch 66 and the second tuning switch 67 are both in the first operation state, an operating band covered by the radiator 61 is a first operating band, which is 862 to 960 MHz. When the first tuning switch 66 is in the second operation state and the second tuning switch 67 is in the first operation state, the operating band covered by the radiator 61 is a second operating band, which is 796 to 862 MHz and 1710 to 2690 MHz. In this embodiment, the operating band covered by the radiator 61 is 796 to 862 MHz and 1710 to 2690 MHz.

Figure 5:
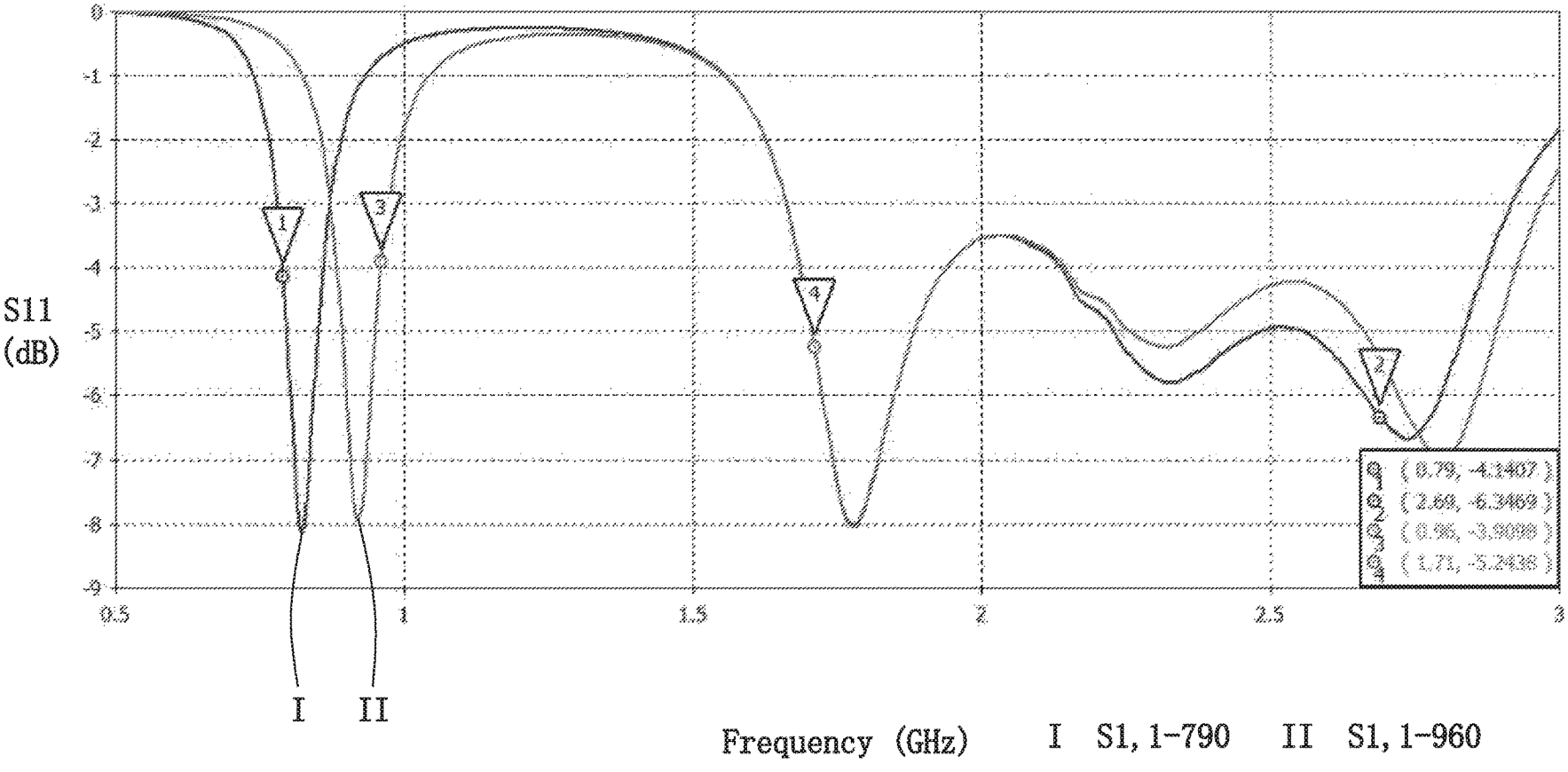
FIG. 5 is a graph showing a return loss simulation effect of an antenna module of a mobile terminal according to the present disclosure.
Figure 6:
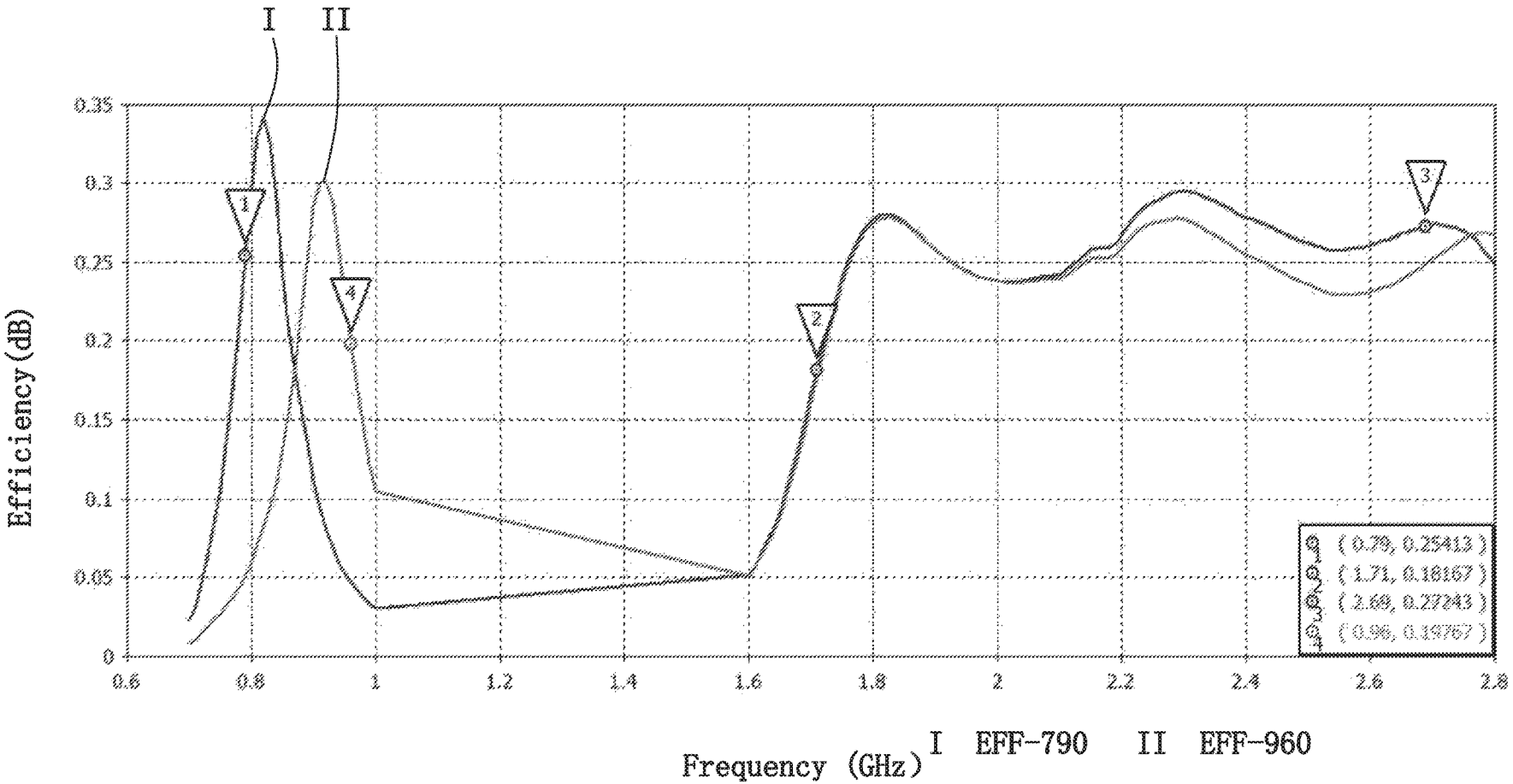
FIG. 6 is a graph showing a radiation efficiency simulation effect of an antenna module of a mobile terminal according to the present disclosure.

Based on the above, when the first tuning switch 66 and the second tuning switch 67 in the antenna module of the present disclosure are in the first operation state and the second operation state, a return loss and radiation efficiency of each operating band are as shown in FIG. 5 and FIG. 6, where abscissas in FIG. 5 and FIG. 6 represent frequency measured in GHz, and ordinates in FIG. 5 and FIG. 6 respectively represent a return loss value and radiation efficiency, both of which are measured in dB.

It should be noted that in other embodiments, the radiator may be formed only in the first shaping zone 51. In this way, the operation process during the LDS laser engraving process is further simplified.

The radiator of the antenna module provided in the present disclosure is entirely laid on the surface of the plastic rear housing facing the back cover. On the one hand, the area of the radiator is large, making LDS wiring less likely to break and significantly improving the drop impact resistance. On the other hand, the antenna module has a simple structure, so that the time and difficulty of radium plating and electroless plating during the LDS process can be reduced, making it easier to form the antenna module.

The foregoing descriptions are merely embodiments of the present disclosure. It should be noted herein that those of ordinary skill in the art may further make improvements without departing from the creative concept of the present disclosure, and such improvements shall all fall within the protection scope of the present disclosure.

What is claimed is:

1. An antenna module, applicable to a mobile terminal, wherein the mobile terminal comprises a back cover, a motherboard received in the back cover and a plastic rear housing located between the back cover and the motherboard and covering the motherboard, the plastic rear housing is adjacent to a bottom of the mobile terminal, and the antenna module comprises a radiator formed on a surface of the plastic rear housing facing the back cover, and a feed point, a first ground point and a second ground point that are disposed on the motherboard, and the antenna module further comprises a matching network, a first tuning switch and a second tuning switch, the feed point is connected to the radiator through the matching network, the first ground point is connected to the radiator through the first tuning switch, and the second ground point is connected to the radiator through the second tuning switch, the surface of the plastic rear housing facing the back cover comprises a first shaping zone for shaping the radiator and a second zone other than the first shaping zone, a boundary line between the first shaping zone and the second zone lies in a first plane perpendicular to the motherboard and parallel to a minor axis of the mobile terminal, the first shaping zone is located on a side of the first plane adjacent to the bottom of the mobile terminal, and the radiator completely covers the first shaping zone.

2. The antenna module according to claim 1, wherein the second zone comprises a second shaping zone for shaping the radiator and a blank zone, the second shaping zone is connected to the first shaping zone, only two boundary lines exist between the second shaping zone and the blank zone, one of the boundary lines lies in a second plane parallel to the first plane, the other boundary line lies in a third plane perpendicular to the first plane and perpendicular to the motherboard, the radiator completely covers the second shaping zone.

3. The antenna module according to claim 1, wherein the radiator is formed on the surface of the plastic rear housing facing the back cover through a laser direct structuring (LDS) process.

4. The antenna module according to claim 1, wherein the first tuning switch and the second tuning switch both have a first operation state, and the first tuning switch further has a second operation state;

when the first tuning switch and the second tuning switch are both in the first operation state, the radiator covers an operating band of 862 to 900 MHz;

when the first tuning switch is in the second operation state and the second tuning switch is in the first operation state, the radiator covers an operating band of 796 to 862 MHz and an operating band of 1710 to 2690 MHz.

5. A mobile terminal, comprising the antenna module according to claim 1.

6. A mobile terminal, comprising the antenna module according to claim 2.

* * * * *